United States Patent [19]

Shaffer

[11] 4,059,353

[45] Nov. 22, 1977

[54] PHOTORECEPTOR BELT SYSTEM

[75] Inventor: Louis W. W. Shaffer, Rochester, N.Y.

[73] Assignee: Xerox Corporation, Stamford, Conn.

[21] Appl. No.: 680,811

[22] Filed: Apr. 28, 1976

[51] Int. Cl.[2] ..... G03G 15/00

[52] U.S. Cl. ..... 355/16

[58] Field of Search ..... 355/16, 3 R, 73

[56] References Cited

U.S. PATENT DOCUMENTS

| | | | |
|---|---|---|---|
| 3,339,469 | 9/1967 | McFarlane | 355/16 |
| 3,451,754 | 6/1969 | Prew | 355/73 |
| 3,653,755 | 4/1972 | Serfahs et al. | 355/3 R |
| 3,694,068 | 9/1972 | Jordan | 355/3 R |

*Primary Examiner*—Donald A. Griffin
*Attorney, Agent, or Firm*—Earl T. Reichert

[57] ABSTRACT

A photoreceptor belt system in which the belt is drawn by vacuum against a flat surface as the belt moves around a closed path has an improved platen cloth or mesh extending over the surface for preventing the belt from contacting the surface, the open area of the mesh being between 20% and 80% of the total area of the mesh. Nylon netting having an open area equal to approximately 40% of its total area has been found to be particularly satisfactory.

2 Claims, 5 Drawing Figures

PHOTORECEPTOR BELT SYSTEM

BACKGROUND OF THE INVENTION

The present invention relates to an improved photoreceptor belt system for an electrostatic reproduction machine.

In conventional xerography, a xerographic plate (photoreceptor) comprising a layer of photosensitive insulating material affixed to a conductive backing is used to support electrostatic latent images. In the xerographic process, the photosensitive surface is electrostatically charged, and the charged surface is then exposed to a light pattern of the image being reproduced to thereby discharge the surface in the areas where light strikes the surface. The undischarged areas of the surface thus form an electrostatic charge pattern (an electrostatic latent image) conforming to the orginal pattern. The latent image is then developed by contacting it with a finely divided electrostatically attractable powder referred to as "toner". Toner is held on the image areas by the electrostatic charge on the surface. Where the charge is greater, a greater amount of toner is deposited. Thus, a toner image is produced in conformity with a light image of the copy being reproduced. Generally, the developed image is then transferred to a suitable transfer member (e.g., paper), and the image is affixed thereto to form a permanent record of the original document.

In the practice of xerography, the transfer member is caused to move in synchronized contact with the photosensitive surface during the transfer operation, and an electrical potential opposite from the polarity of the toner is applied to the side of the paper remote from the photosensitive surface to electrostatically attract the toner image from the surface to the paper.

In a modern high-speed electrostatic reproduction machine, the photoreceptor is in the form of an endless belt, and the belt is mounted over a plurality of rollers for movement around a closed path. During its movement, the belt is held against a flat perforated plate by a vacuum, there being a platen cloth stretched over the plate so as to prevent direct contact between the belt and plate. It was noted by the Applicant that during high volume runs on such a machine, two machine problems consistently delayed or terminated such runs. These two problems were false paper jams, and the photoreceptor being scratched during machine operation. During investigation, the Applicant eventually discovered that both of these problems were caused by the same thing — dirty or contaminated platen cloths. These prior art platen cloths are made of densely woven white nylon, and they become contaminated with oversprayed interface material (polycarbonate and polyurethane) and toner which may require that the cloths be changed after as few as 60K copies are made. The photoreceptor life is normally greater than 120K copies. Thus, not only do contaminated platen cloths cause the above two problems, but they further increase the risk of scratching or otherwise damaging the photoreceptors while removing the dirty cloths and installing clean cloths since the photoreceptors must be removed and handled in order to change the cloths.

The applicant found that both the false paper jams and the scratching of the photoreceptor during machine operation were due to buckling of the photoreceptor belt, and that the buckling was caused by excessive contamination of the platen cloth which increased the coefficient of friction between the back of the belt and the cloth. A contaminated platen cloth has a larger surface area of contact than an uncontaminated cloth, and consequently the coefficient of friction between a photoreceptor belt and the former will be larger than between the photoreceptor belt and the latter. A main drive roller "pulls" the photoreceptor belt from an idler roller and "pushes" the belt toward and across a cleaning station where residual toner is cleaned from the photoreceptor belt. As the photoreceptor belt is "pushed" toward the cleaning station, the belt passes a detecting means or sensor located just upstream of the cleaning station and adjacent to the belt. Normally, this sensor senses when a copy has not been stripped from the photoreceptor, causes the machine to stop and indicates that there is a paper jam. The sensor includes a light source and a light receiver, and distinguishes paper as a change in reflectance. As the photoreceptor belt is "pushed" toward the sensor, and as the platen cloth becomes increasingly contaminated, a wave or "buckle" forms in the photoreceptor belt which causes a false mis-strip jam; the buckle causes a change in the coefficient of reflection which is sensed as a mis-strip by the sensor. When the buckle in the photoreceptor belt becomes severe enough, it actually contacts the sensor and scratches the belt.

During his investigation, the Applicant also discovered that prior art platen cloths appear to be contributing to or creating another long standing problem namely, "pink-banding" (crystallization of the photosensitive layer). Crystallization of the photosensitive surface reduces the effectiveness thereof and consequently results in lowering copy quality. The applicant discovered that photoreceptor belts used with prior art platen cloths show a marked correlation between the "pink-band" patterns on the photosensitive surfaces of the belts, and the scumming or streaking patterns on the backs of the belts. Thus, it appears that contamination of prior art platen cloths with toner increases friction between the photoreceptor belts and the cloths which increases the heat in local "bands" which results in fusing toner to the back of the photoreceptor belt which results in local crystallization or "pink-banding" of the photosensitive surface of the photoreceptor belt. Contamination of the platen cloth also decreases the vacuum applied to the back of the belt which reduces the heat sink and causes the belt to get even hotter.

SUMMARY OF THE INVENTION

A primary object of the present invention is to overcome the above problems by incorporating an improved platen cloth into a photoreceptor belt system. The contact surface area of the improved platen cloth is significantly less than that of a prior art platen cloth, and the contact surface area of the improved cloth remains less than that of a prior art cloth throughout the operation of the electrostatic reproduction machine because the former cloth does not become as contaminated as the latter. Consequently, the coefficient of friction between the improved cloth and the photoreceptor belt will always be less than that between a prior art platen cloth and photoreceptor belt for any given material or materials.

In addition, it is an object of the present invention to lessen the stringent requirements (presently in existence) relating to the manufacture of photoreceptor belts. As stated above, photoreceptor belts have a photosensitive layer such as selenium on a nickle substrate.

At present, the process control for this substrate is closely related to the tolerances of the apparatus used to manufacture the photoreceptor belt. If the back of the photoreceptor belt is too smooth, the coefficient of friction increases because of the large area of contact between the belt and the cloth. By using the applicant's improved platen cloth in a photoreceptor belt system, it is possible to relax the tolerances of the manufacturing apparatus.

The present invention is directed to an improved photoreceptor belt system for an electrostatic reproduction machine. An endless photoreceptor belt is mounted on rollers for movement around a closed path. As the belt moves around the closed path, a vacuum pulls the belt against a flat perforated plate. The improvement lies in a platen cloth or mesh stretched across the plate between the belt and the plate to prevent the back of the belt from directly contacting the plate, approximately 20% to 80% of the total area of the cloth being uniformly open. Although various materials or combinations of materials may be used for the cloth, e.g., Teflon, Dacron, graphite, etc., and although the cloth may be woven or unwoven, the applicant has found that nylon netting having an open area which is approximately 40% of the total area of the cloth is quite satisfactory.

DESCRIPTION OF THE INVENTION

Figure 1:
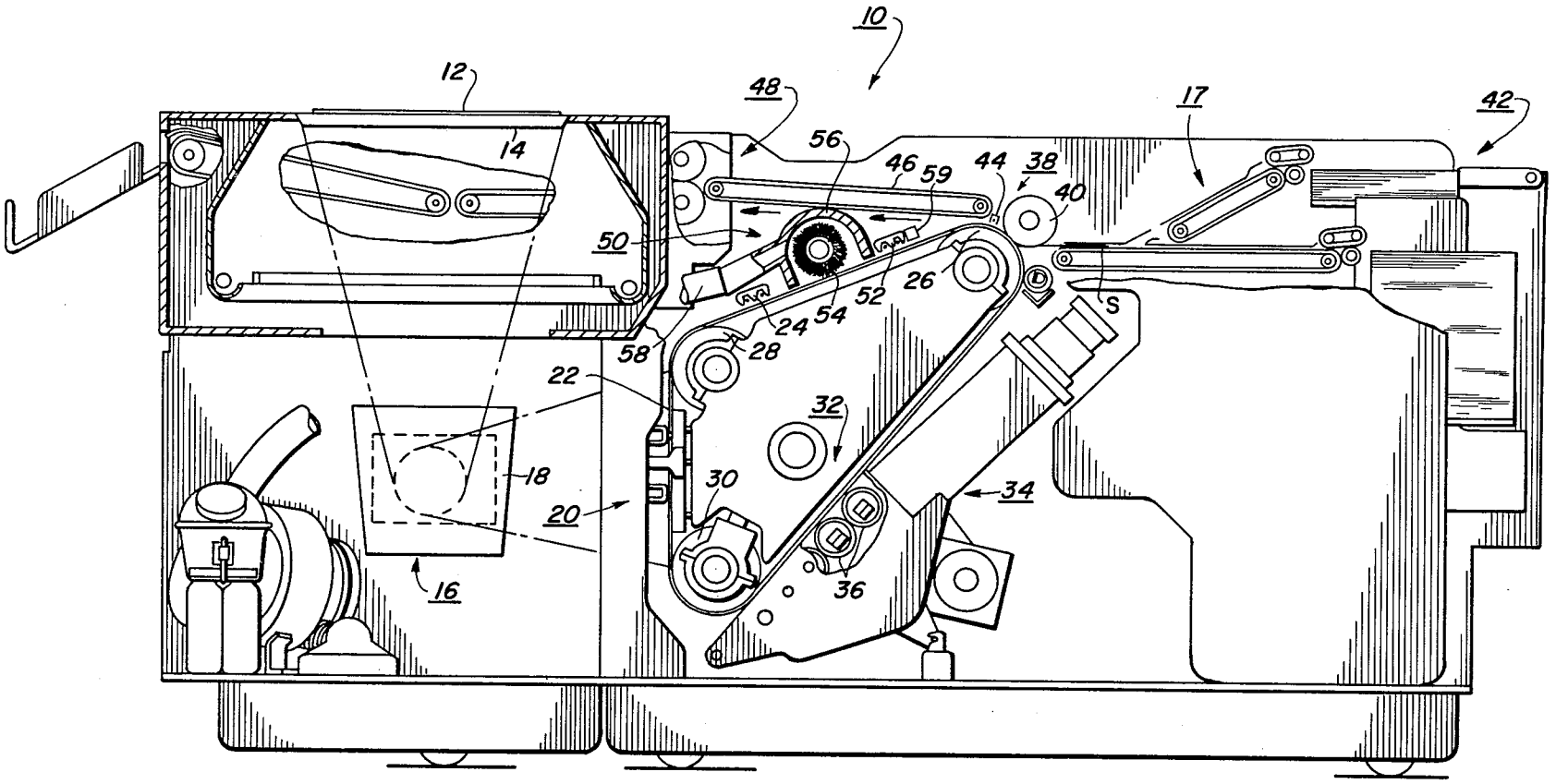
FIG. 1 is a schematic sectional view of an electrostatic reproduction machine showing the various processing stations.

For a general understanding of an electrostatic reproduction machine in which the present invention may be incorporated, reference is made to FIG. 1. As in all electrostatic reproduction machines of the type illustrated, a light image of an original is projected onto the photosensitive surface of a xerographic plate to form an electrostatic latent image thereon. Thereafter, the latent image is developed with an oppositely charged developing material comprising carrier beads and toner particles triboelectrically adhering thereto to form a xerographic powder image corresponding to the latent image on the photosensitive surface. The powder image is then electrostatically transferred to a transfer member such as a sheet of paper to which it may be fixed by a fusing device whereby the toner image is caused to adhere permanently to the transfer member.

In the illustrated machine 10, an original 12 to be copied is placed upon a transparent support platen 14 fixedly arranged in an illumination assembly indicated generally by the reference numeral 16. While upon the platen, the illumination assembly flashes light rays upon the original, thereby producing image rays corresponding to the informational areas on the original. The image rays are projected by means of an optical system 18 to an exposure station 20 for exposing the surface of a moving xerographic plate in the form of a flexible photoconductive belt or photoreceptor 22. In moving in the direction indicated by the arrow, that portion of the belt being exposed would have been uniformly charged to approximately +900 volts by a corona generating device 24 located at a belt run extending between the main drive rollers 26 and 28. The exposure station extends between the roller 28 and a third roller 30.

The exposure of the photosensitive surface of the belt to the light image discharges the surface in the areas struck by light whereby an electrostatic latent image remains on the belt in image configuration corresponding to the light image projected from the original on the support platen. As the belt continues its movement, the latent image passes around the roller 30 and through a developing station 32 where a developer indicated generally by the reference numeral 34 is positioned. The developer 34 comprises a plurality of magnetic brushes 36 which carry developing material to the surface of the upwardly moving belt 22. As the developer is applied to the belt, toner particles in the development material are electrostatically attracted to the charged photosensitive surface to form a powder image (a developed image).

The developed image is transported by the belt 22 to a transfer station 38 where a sheet of paper is moved at a speed in synchronism with the moving belt in order to effect transfer of the developed image. Located at the transfer station 38 is a transfer roll 40 which is arranged on the frame of the machine to contact the back side of the sheet of paper as the latter is moved or fed between the belt and the transfer roll. The roll 40 is electrically biased with sufficient voltage so that the developed image on the belt may be electrostatically attracted to the adjacent side of a sheet of paper as the latter is brought into contact therewith. A suitable sheet transport mechanism transports sheets of paper seriatim from a paper handling mechanism indicated generally by the reference numeral 42 to the developed image on the belt as the same is carried around the roller 26.

As a sheet emerges from the transfer station 38, a charge is deposited thereon by a detack corona generating device 44 to lessen the electrostatic attraction between the belt 22 and the sheet so that the latter can be removed by a vacuum stripping and transport mechanism 46. The sheet is thereafter retained on the underside of the vacuum stripping transport mechanism 46 for movement into a fuser assembly indicated generally by the reference numeral 48 wherein the powder image on the sheet is permanently affixed thereto. After fusing, the finished copy is discharged at a suitable point for collection. The toner particles remaining as residue on the belt 22 are carried by the belt to a cleaning apparatus 50. The cleaning apparatus 50 comprises a corona discharge device 52 for neutralizing charges remaining on the untransferred toner particles, a rotating brush 54 mounted within a housing 56, and a vacuum outlet 58. It should also be noted that a mis-strip sensor 59 is mounted adjacent to the device 52 for detecting any copies which have not been stripped from the photoreceptor belt 22.

Figure 2:
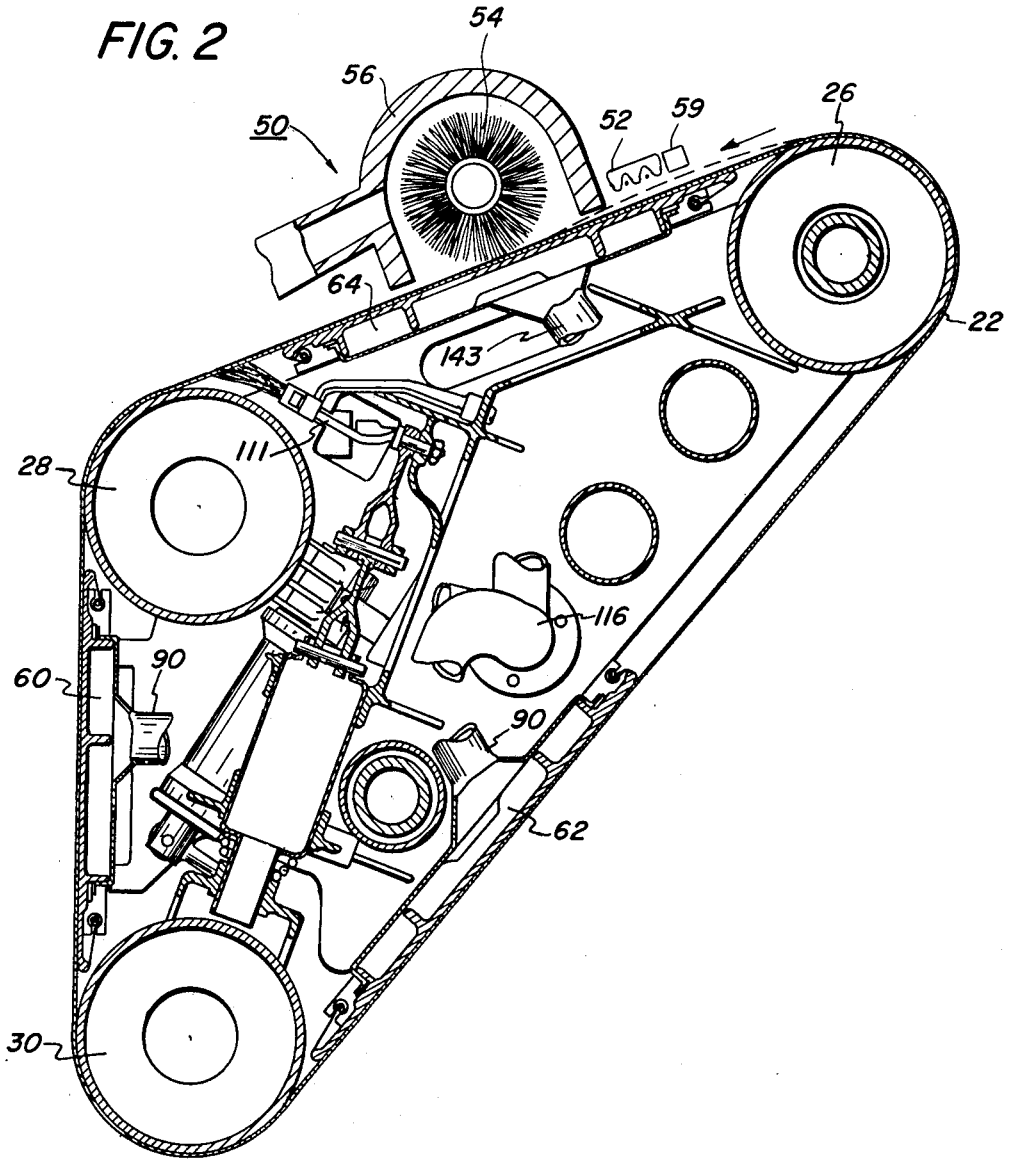
FIG. 2 is a cross-sectional view of a photoreceptor belt assembly as seen from the front of the machine.

As shown in FIG. 2, the belt assembly is in a form which provides three belt runs, that is, sections of the belt that lie in flat planes. In order to provide runs which are truly flat and which insure the positioning of a belt run in a precisely located plane, and free of vibration or inadvertent deflection, the belt assembly is provided with a flat vacuum holddown device for each of the runs. To this end, the exposure belt run, that is, the run between the rollers 28 and 30 has associated therewith a holddown device 60, the development run between the rollers 30 and 26 has a holddown device 62, and the cleaning run between the rollers 26 and 28 has a holddown device 64. Since each of the devices are the same, except for size, only one, the development holddown device 60 will be described below.

Figure 3:
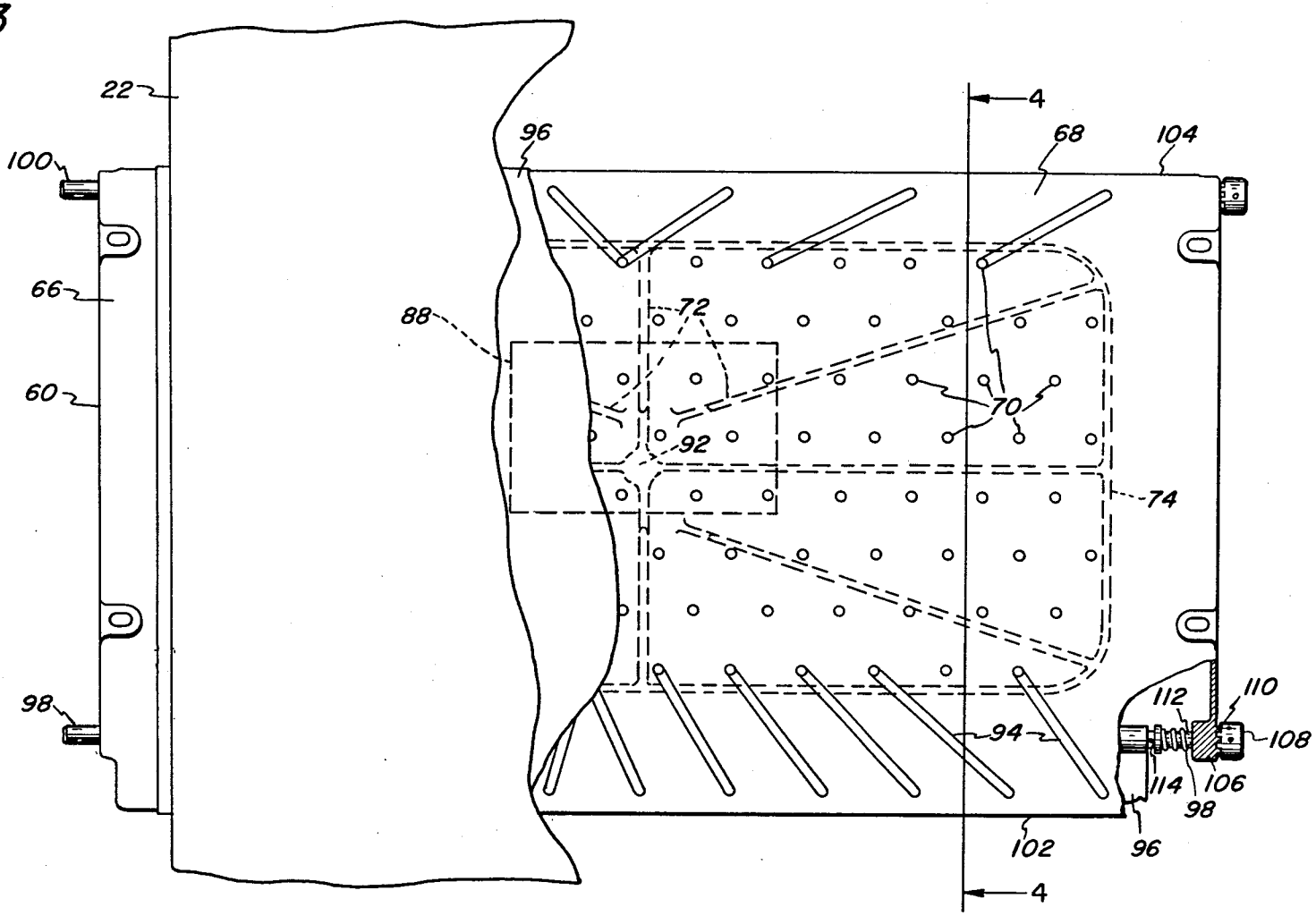
FIG. 3 is a plan view, partly broken away, of a vacuum holddown device for the belt.
Figure 4:
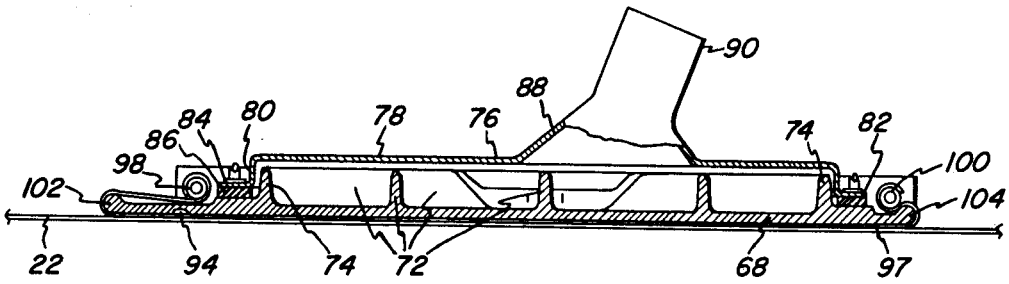
FIG. 4 is a sectional view taken along lines 4—4 in FIG. 3 showing the holddown device in an inoperative condition.

Referring to FIGS. 3 and 4, it can be seen that the vacuum holddown device 60 comprises a vacuum plenum 66 having a flat plate 68 formed with many openings or perforations 70 upon which the belt 22 is stretched during movement. On the side of the plate away from the belt 22, the plenum includes a plurality of ribs 72 made integral with plate and projecting from the surface thereof. Along with the ribs, there is also integrally formed on the same side of the plate 68, a circumferential guard wall 74 which is connected to the exterior ends of all the ribs 72, the guard wall surrounding all of the openings 70.

The spaces between the ribs 72 and the circumferential wall 74 are closed off on that side of the plate 68 by a manifold 76 made of flexible plastic material and having a relatively flat web portion 78 positioned to span across all of the ribs and the wall 74. The outer circumferential edge of the manifold 76 is formed with a wall 80 which extends toward the plate 68 and completely surrounds the wall 74. The wall 80 terminates in a flange 82 which is secured to the adjacent surface of the plate 68 by suitable lock washer 84. In order to insure a vacuum seal with the interior chamber defined by the flat portion 78 of the manifold 76 and the plate 68, a circumferential gasket 86 or sealing device is positioned between the flange 82 and the plate. The manifold 76 also includes a chamber 88 formed with material from the web portion 78 and which terminates in a hose connector 90 to which a hose of an air evacuation system may be secured. The chamber walls 88 extend beyond the plane of the web portion 78 approximately centrally of the plate 68 in order to provide access to all of the spaces between the ribs 72. As shown in FIG. 3, the chamber is in communication with all of the spaces between all of the ribs 72 some of which terminate short of the central core section 92 of the vertical and horizontal ribs a viewed in this figure.

In order to extend the vacuum effectiveness of the holddown device 62, the plate 68 on the side supporting the belt 22 is formed with grooves 94 of semi-circular cross-section connected to some of the outermost series of openings 70 and terminating adjacent the outer edges of the plate 68. Since air is evacuated out of the space defined by the circumferential wall 74 within which the outermost series of openings 70 are confined, the effect of the vacuum produced by this evacuation of air will be felt at the extreme outer limits of the grooves 94 and along the same. With the belt applied to the outer surface of the plenum plate 68, as shown in FIG. 3, and with the plenum subjected to a vacuum producing system, the belt will be forced against the plate by the resultant pressure differential effected between the spaces on either side of the plate 68. The effect of this force on the belt will extend between the outer ends of the series of grooves 94 on one edge of the plate 68 to the outer ends of the series of grooves at the other edge of the plate.

The force holding the belt against the plate 68 is continuous as the belt moves over the rollers 26, 28, and 30, and keeps the belt flat against the plate. The holddown device 62 keeps the belt a fixed distance away from the magnetic brushes in the developer 34. The vacuum holddown devices 60 and 64 function in the same manner to keep the belt 22 in a given plane as it moves through the exposure and cleaning-charging zones. Each of the vacuum holddown devices is provided with an improved platen cloth or mesh 96 This mesh will be discussed in detail below.

The mesh 96 is maintained on the outer surface of the plenum plate 68 by means of a pair of parallel arranged rods 98, 100 secured to each end of the material and held in fixed positions under the outer edges of the plenum plate. As shown in FIG. 4, the mesh 96 turns around both outer edges 102, 104 of the plate 68 with one end of the material wrapped around the rod 100 for a few turns and the other end of the material wrapped around the rod 102 for a few turns.

The rod 98 adjacent the plate edge 102 is journaled for rotation in a pair of aligned bosses 106 (one of which is shown in FIG. 3) located at opposite ends of the plenum 68. Since both of the rods 98, 100 and their associated structure are identical, only the rod 98 and attendent structure will be described in detail. The rod 98 extends through and is slidably retained by the boss 106 and has one of its outer ends secured to a knob 108 which is formed on one side with serrations 110. These serrations are engageable with corresponding serrations formed in the outer surface of the boss 106 and when engaged therewith, prevents the knob and the rod 98 from rotation. The knob is forced against the boss so that the cooperating serrations are interlocked by means of a coil spring 112 which encircles the rod 98 and held in light compression between the inside surface of the boss and a pin 114 secured to the rod. With this arrangement, in order to place the mesh 96 under tension, an operator need only pull the knob 108 against the bias of the spring 112 to disengage the serrations, and then turn the knob in a direction which will wind the mesh around the rod 98. To remove the mesh, the rod 98 need only be rotated to unravel the mesh carried thereby. Suitable gripping devices may be provided on each of the rods 98, 100 for securing ends of the material and permit winding upon each of the rods.

Figure 5:
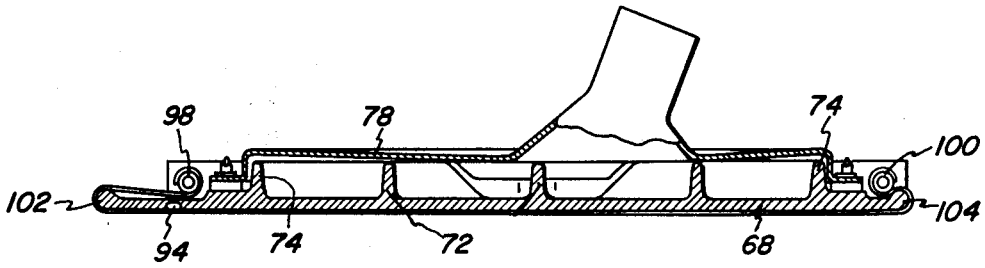
FIG. 5 is a view similar to that in FIG. 4 but showing another condition of operation.

During machine shutdown when the vacuum producing means is inoperative, the web portion 78 for the manifold 76 is in its flattened, unstressed condition as shown in FIG. 4. When the vacuum producing means is rendered operative, air is drawn from the external circuitry of the plenum 68, through the mesh 96 and openings 70, through the spaces between the ribs 72 and within the wall 74 and out of the chamber 88. With the belt 22 being applied against the plenum 68, a vacuum is produced in these spaces to cause the belt to be drawn under force to the plate 68 and cause the web portion 78 to flex and be drawn against the adjacent edges of the ribs 72, as shown in FIG. 5. Normally, when not so fixed, the web portion 78 is spaced slightly from these edges of the ribs thereby maintaining the manifold 76 and the plenum 68 in an unstressed condition. Under vacuum conditions, however, the flexing of the web 78 eliminates actual flexing of the plate 68. The material the manifold 76 is made of is such that it permits the flexing of the web portion 78 with less force than the force necessary to cause flexing of the plate 68. When the web 78 contacts the ribs 72, the atmospheric pressure on both sides of the holddown device equalize and there is no plate deflection. The only load on the plate 68 is the weight of the plate itself plus the loads of the extraneous processing devices in contact with the belt 22 at this point.

As previously stated, the vacuum holddown devices 60, 62, and 64 are structurally and functionally similar. Each is provided with a chamber 88 and a hose connector 90, as shown in FIG. 2. All of these hose connectors are joined to a common pipe 116 which leads to a source of vacuum.

Referring to FIG. 2, the invention will now be discussed in detail. The mesh 96 is electrically insulating since the surface of the belt 22 which slides across the material and which is under considerable force is conductive. The mesh 96 electrically insulates this conductive surface of the belt 22 from the plate 68. Although various materials or combinations of materials may be used for the platen cloth, e.g., Teflon, Dacron, graphite, etc. and although the cloth may be woven or umwoven, the Applicant has found that nylon netting which has an open area which is approximately 40% of the total area of the cloth is particularly satisfactory for substantially reducing or solving the problems associated with prior art cloths. To further reduce the area of contact between the photoreceptor belt and the platen cloth, the latter may have nodules or raised portions where strands intersect so that the belt can ride on these nodules as it moves over the cloth. As discussed above, two of the main problems associated with prior art platen cloths were false mis-strip jams and scratching of the photoreceptor belt 22. As a prior art platen cloth became increasingly contaminated during the operation of the machine, its surface area and consequently the coefficient of friction between the cloth and the photoreceptor belt 22 became higher. As can be seen in FIG. 2, the main drive roller 26 "pushes" the photoreceptor belt 22 across the cleaning platen 64, and when the coefficient of friction between the belt and the platen cloth becomes high enough, a wave or buckle (indicated by the dotted line) forms in the belt. Because the sensor uses a light source and a pickup to detect a copy which has not been stripped from the belt 22 (a mis-strip), the buckle in the belt changes the coefficient of reflection which in turn causes the sensor to indicate a mis-strip jam and terminate the operation of the machine even though no mis-strip has occurred. If the buckle in the belt 22 becomes severe enough, it eventually contacts the sensor 59 which scratches the photosensitive surface of the belt. The applicant's improved platen cloth substantially reduces or eliminates these two main problems in addition to the other problems discussed earlier because the surface area of this cloth is substantially less than that of a prior art cloth. Since only a very small percentage (approximately 2% to 5%) of the total area of prior art platen cloths is open, any cloth having a substantially greater percentage (20% to 80%) of open area than this should substantially reduce the rate of contamination, and consequently reduce the coefficient of friction between the photoreceptor belt 22 and the platen cloth; a sufficiently low coefficient of friction eliminates belt buckle.

While the invention has been described with reference to the structure disclosed, it is not confined to the details set forth, but is intended to cover such modifications or changes as may come within the scope of the following claims.

What is claimed is:

1. An improved photoreceptor belt system having an endless flexible photoreceptor belt, means for mounting the belt for movement around a closed path which includes a flat run, means defining a planar surface along the run, and means for drawing the belt toward the surface as the belt moves around the closed path, wherein the improvement comprises:

a mesh extending across the surface for preventing the belt from contacting the surface as the belt moves around the closed path, the open area of the mesh being approximately 40% of the total area of the mesh to minimize the rate of contamination of the mesh and consequently minimize the coefficient of friction between the photoreceptor belt and the mesh.

2. An improved photoreceptor belt system as set forth in claim 1, wherein the mesh is nylon netting.

* * * * *